US008225841B1

(12) United States Patent
Davidson

(10) Patent No.: US 8,225,841 B1
(45) Date of Patent: Jul. 24, 2012

(54) CENTRAL SPRUE FOR INVESTMENT CASTING

(75) Inventor: Bill Davidson, Boerne, TX (US)

(73) Assignee: James Avery Craftsman, Inc., Kerrville, TX (US)

( * ) Notice: Subject to any disclaimer, the term of this patent is extended or adjusted under 35 U.S.C. 154(b) by 0 days.

(21) Appl. No.: 12/983,740

(22) Filed: Jan. 3, 2011

(51) Int. Cl.
*B22C 9/04* (2006.01)

(52) U.S. Cl. ..... 164/35; 164/235; 164/516

(58) Field of Classification Search ..... 164/34–36, 164/235, 516
See application file for complete search history.

(56) References Cited

U.S. PATENT DOCUMENTS

| | | | |
|---|---|---|---|
| 3,015,138 | A | 1/1962 | Watts |
| 3,177,537 | A | 4/1965 | Horton |
| 3,946,039 | A | 3/1976 | Walz |
| 3,989,088 | A | 11/1976 | Weissman et al. |
| 4,003,423 | A | 1/1977 | Shikinai et al. |
| 4,040,466 | A | 8/1977 | Horton et al. |
| 4,081,019 | A | 3/1978 | Kulig |
| 4,161,208 | A | 7/1979 | Cooper |
| 4,170,256 | A | 10/1979 | Blazek et al. |
| 4,240,492 | A | 12/1980 | Edwards et al. |
| 4,240,493 | A | 12/1980 | Wilmarth |
| 4,300,617 | A | 11/1981 | Bauer |
| 4,316,498 | A | 2/1982 | Horton |
| 4,326,326 | A | 4/1982 | MacDonald |
| 4,340,107 | A | 7/1982 | Bauer |
| 4,346,750 | A | 8/1982 | Nemethy |
| 4,421,153 | A | 12/1983 | Wilkinson et al. |
| 4,492,577 | A | 1/1985 | Farris et al. |
| 4,558,841 | A | 12/1985 | Engelman et al. |
| 4,651,801 | A | 3/1987 | Sasaki |
| 4,682,644 | A | 7/1987 | Ueno |
| 4,700,760 | A | 10/1987 | Weingarten |
| 4,721,149 | A | 1/1988 | Hesterberg et al. |
| 4,741,378 | A | 5/1988 | Engelman et al. |
| 4,766,942 | A | 8/1988 | Wessman et al. |
| 4,888,213 | A | 12/1989 | Hesterberg |
| 4,981,167 | A | 1/1991 | Anderson |
| 5,004,037 | A | 4/1991 | Castaldo |
| 5,044,419 | A | 9/1991 | Ware |
| 5,140,869 | A | 8/1992 | Mrdjenovich et al. |
| 5,175,008 | A | 12/1992 | Ueno |
| 5,234,045 | A | 8/1993 | Cisko |
| 5,244,187 | A | 9/1993 | Manginelli |
| 5,257,658 | A | 11/1993 | Perera |
| 5,297,609 | A | 3/1994 | Cook |
| 5,318,093 | A | 6/1994 | MacDonald |
| 5,348,073 | A | 9/1994 | Kubo et al. |
| 5,364,889 | A | 11/1994 | Quinn et al. |
| 5,372,177 | A | 12/1994 | Foster |

(Continued)

OTHER PUBLICATIONS

Jurgen J. Maerz, Casting Tree Design and Investment Technique for Induction Platinum Casting, Internet source (http://www.platinumguild.com/output/page2414.asp , click on "Casting Tree Design and Investment Technique for Induction Platinum Casting"), 2002.

*Primary Examiner* — Kuang Lin
(74) *Attorney, Agent, or Firm* — Cox Smith Matthews Incorporated

(57) ABSTRACT

A sprue for use in investment casting may comprise a pin and a shell enclosing a part of the pin. A method for creating a sprue may comprise partially enclosing a pin in a shell.

4 Claims, 6 Drawing Sheets

U.S. PATENT DOCUMENTS 5,465,780 A 11/1995 Muntner et al.
5,688,533 A 11/1997 Berger
5,713,410 A 2/1998 LaSalle et al.
5,735,335 A 4/1998 Gilmore et al.
5,735,336 A 4/1998 Oti
5,735,692 A 4/1998 Berger
5,749,411 A 5/1998 Zielinski et al.
5,836,830 A 11/1998 Onuki et al.
5,855,237 A 1/1999 Okada et al.
5,868,194 A 2/1999 Horwood
5,893,405 A 4/1999 Berger
5,897,592 A 4/1999 Caldarise et al.
5,909,765 A 6/1999 McDowell
5,965,171 A 10/1999 Katto et al.
6,004,368 A 12/1999 Chandley et al.
6,283,755 B1 9/2001 Bergstrom et al.
6,298,904 B2 10/2001 Polich
6,344,160 B1 2/2002 Holtzberg
6,349,758 B1 2/2002 Bell
6,382,217 B2 5/2002 Coker et al.
6,467,530 B1 10/2002 Bell
6,467,531 B1 10/2002 Doney
6,488,074 B2 12/2002 Usui
6,551,396 B1 4/2003 Pineda et al.
6,637,497 B2 10/2003 Herron
6,667,112 B2 12/2003 Prasad et al.
6,684,934 B1 2/2004 Cargill et al.
6,779,590 B2 8/2004 Pineda et al.
6,880,615 B2 4/2005 Cser
6,997,818 B2 2/2006 Kouno
7,048,030 B1 5/2006 Eisele et al.
7,114,547 B2 10/2006 Sullivan et al.
7,204,296 B2 4/2007 Redemske et al.
7,237,375 B2 7/2007 Humcke et al.
7,281,566 B2 10/2007 Chikugo et al.
7,296,438 B2 11/2007 Kolb
7,303,392 B1 12/2007 Schermerhorn et al.
7,325,585 B1 2/2008 Benetti
7,343,730 B2 3/2008 Humcke et al.
7,461,684 B2 12/2008 Liu et al.
7,463,942 B2 12/2008 O'Brien et al.
7,475,717 B2 1/2009 Chikugo et al.
7,491,136 B2 2/2009 Deng et al.
7,628,604 B2 12/2009 Schuessler
7,942,189 B1 * 5/2011 Quraishi et al. ..... 164/35
2002/0162642 A1 11/2002 Walker, Sr.
2004/0060685 A1 4/2004 Ray et al.
2006/0021730 A1 2/2006 Marcin, Jr.
2006/0032600 A1 2/2006 Bjork
2006/0175037 A1 8/2006 Chikugo et al.
2007/0295470 A1 12/2007 Chikugo et al.
2008/0000607 A1 1/2008 Chikugo et al.
2008/0202718 A1 8/2008 Paul et al.
2008/0232999 A1 9/2008 Fogel
2010/0003619 A1 1/2010 Das et al.
2010/0006252 A1 1/2010 Roby

* cited by examiner

CENTRAL SPRUE FOR INVESTMENT CASTING

FIELD

The disclosed method and apparatus pertain to the manufacturing of items by investment casting.

BACKGROUND

The lost wax investment casting process may be used to manufacture a variety of items, including jewelry, ornaments, figurines, dental components and industrial parts. In the lost wax investment casting process, a wax or plastic pattern of an item may be created by, for example, injecting wax or plastic into a rubber or metal mold, or by hand carving. These patterns 11 may then be attached to a sprue 10 to create a pattern or casting "tree" 13, such as that illustrated in FIGS. 1A and 1B. The sprue 10 is typically a constant diameter cylinder formed of solid wax or plastic by extrusion or injection molding. The sprue 10 may be mounted in a base 12 that may hold the sprue 10 in a substantially stable orientation. The base 12 may comprise a cone 14 for holding the sprue 10, and lip 16 for sealing the base 12 to a flask (not shown).

The wax or plastic patterns 11 may be affixed to the sprue 10 using a variety of methods and tools, such as with softened wax or plastic or with adhesive. The finished tree 13 may then be placed in a container called a flask (not shown). The base 12 may serve as a base or lid for the flask. Powdered investment material and water may be mixed. The investment mixture may be poured into the flask, submerging the tree 13 of patterns 11. After the investment mixture solidifies, the flask may be heated to cure the investment material to strengthen it into an investment mold into which molten metal may be poured. The base 12 may be removed after the investment mold has set and before heating. During the flask "curing" process, the patterns 11 and sprue 10 may be melted and/or burned out of the investment mold, leaving mold cavities of the pattern shape and channels into which molten metal may flow. The patterns may also be removed by chemical dissolution. Once the curing and burnout process is complete, the flask may be placed in a casting machine. Molten metal may then be poured into the investment mold. The cavity created in the investment mold by the cone 14 of the base 12 may serve to funnel the molten metal into the channels and pattern cavities formed in the investment mold by the tree. After the metal solidifies, the investment mold may be removed, and the cast objects may be cut from the tree and finished.

Using a solid wax or plastic sprue may result in increased wax or plastic material costs, in increased burnout emissions and byproducts, in trees that bend or twist as patterns are attached to the tree, in relatively large sprues that leave correspondingly large channels to be filled by molten metal, and in excessively wide channels that increase turbulence of molten metal as it flows into the flask. For example, if the sprue bends or twists in the flask, some patterns may be pushed closer to one side of the flask, resulting in an investment mold that is weaker in that area. Greater mold non-uniformity may increase the risk that the investment mold will break during curing and use. There exists a need for a method and apparatus for reducing or eliminating one or more of those disadvantages.

SUMMARY

A sprue for use in investment casting may comprise a pin and a shell enclosing a part of the pin. A method for creating a sprue may comprise partially enclosing a pin in a shell.

DETAILED DESCRIPTION

Figure 1A:
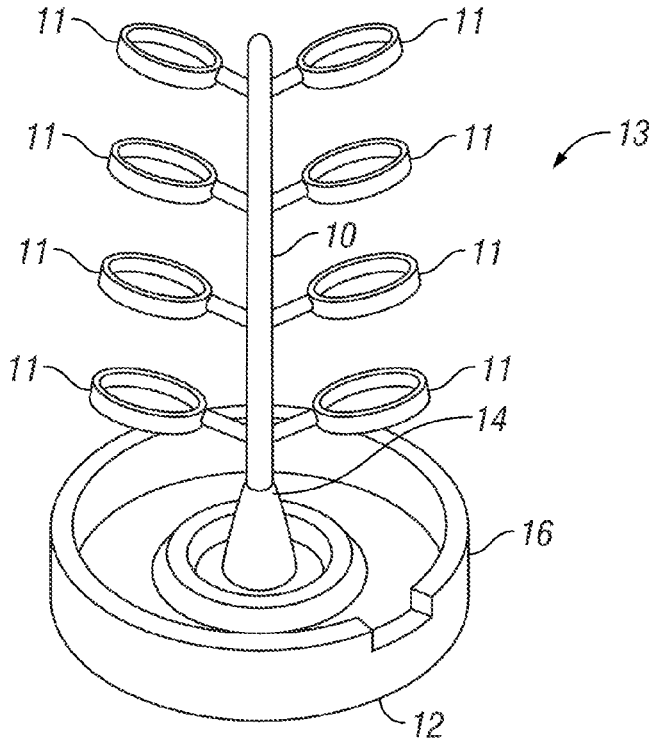
FIG. 1A provides a perspective view of an embodiment of a prior art sprue with patterns attached.
Figure 1B:
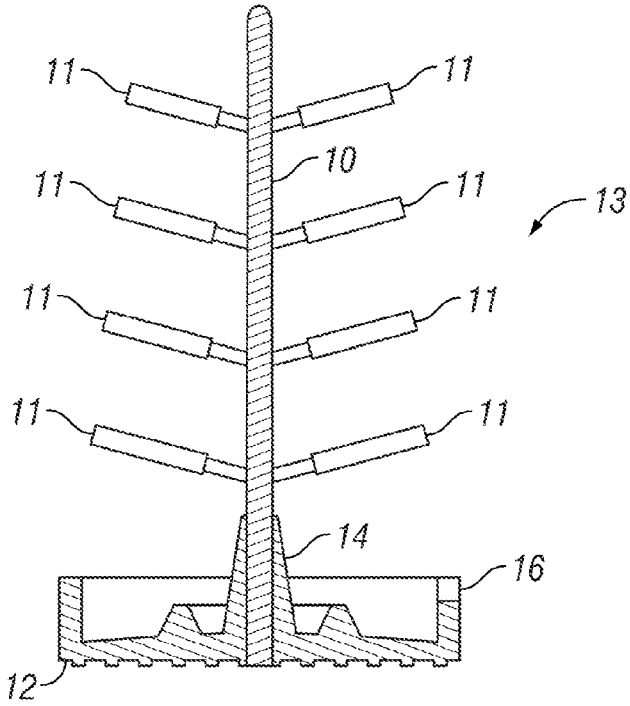
FIG. 1B provides a side cross-sectional view of the sprue, patterns and base of FIG. 1A.
Figure 2A:
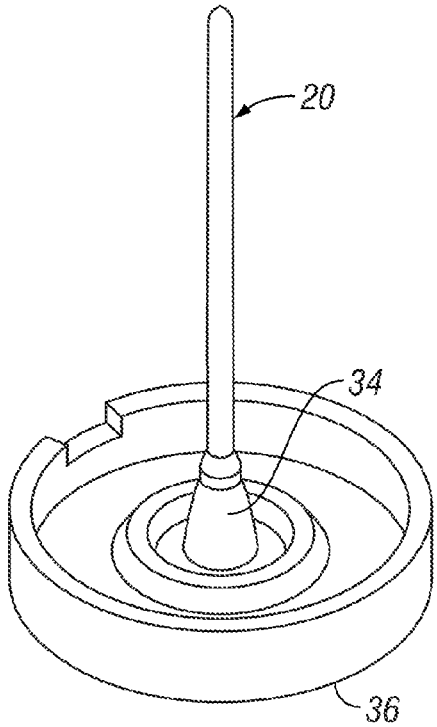
FIG. 2A provides a perspective view of an embodiment of a sprue comprising a pin and a shell.
Figure 2B:
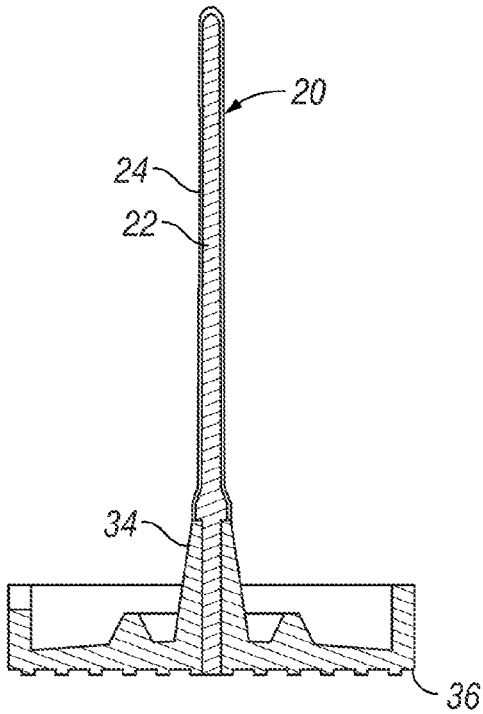
FIG. 2B provides a side cross-sectional view of the sprue of FIG. 2.

With reference to the embodiment of FIGS. 2A and 2B, a sprue 20 may comprise a pin 22 and a shell 24. The pin 22 may be inserted into the cone 34 of a base 36 to mount the sprue 20 to the base 36 in a relatively stable orientation. The base 36 may be substantially rigid or relatively flexible, or a combination of rigid and flexible parts. For example, the cone 34 may be relatively rigid and the remainder of the base may be relatively flexible to allow sealable mounting to a flask (not shown).

Figure 3:
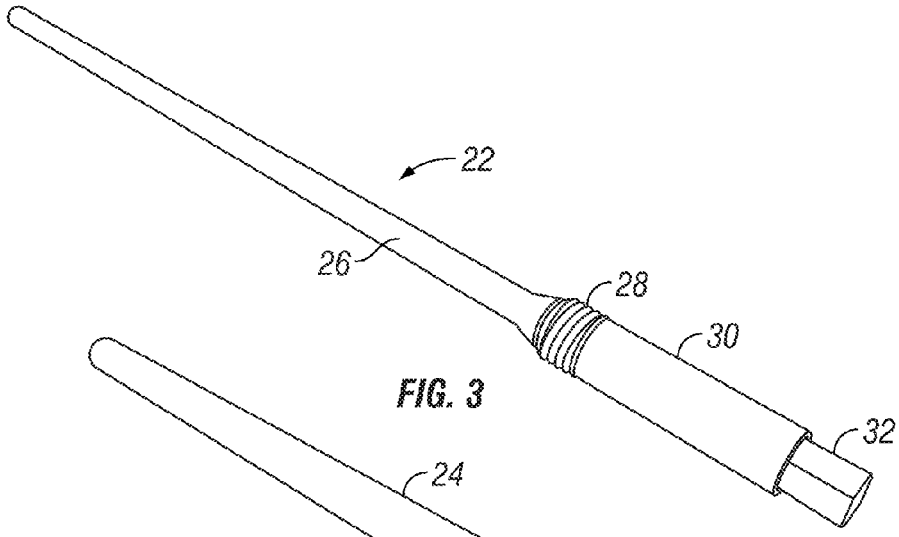
FIG. 3 provides a perspective view of an embodiment of a pin for a sprue.

With reference to the embodiment of FIG. 3, a pin 22 may comprise a pin shaft 26, a pin shoulder 28 and a support section 30. Preferably the pin shaft 26 may be tapered. The pin shoulder 28 may be of a different diameter or cross-sectional area than the pin shaft 26, and may taper or curve to meet the pin shaft 26. In some embodiments, the pin shoulder 28 may have a major diameter that is the same as the major diameter of the support section 30, or may have a greater major diameter than that of the support section 30 to better seat the pin 22 in the base (for example, as may be seen in the embodiment of FIG. 2B). Preferably, the pin shoulder 28 may be substantially smooth. Alternatively, the pin shoulder 28 may be provided with threads (as in the embodiment of FIG. 3). In other embodiments, the pin 22 may comprise a pin shaft 26 and support section 30 without shoulder section 28, such that the pin shaft tapers directly to the support section 30. The support section 30 may have a varying or substantially constant cross-sectional area, and may be configured for insertion into the cone 34 of a base 36 (as in FIGS. 2A and 2B).

The support section 30 may comprise a base end 32 having a variety of cross-sectional shapes, for example, of round, square, hexagonal, triangular or other suitable cross-sectional shape. Non-round cross-sectional shapes may allow a mold technician to more easily remove the pin 22 from the shell 24 using a turning force such as by using a wrench. Alternatively, the base end 32 may be provided with one or more slots or other apertures (not shown) configured to receive tools or keys, such as a screwdriver, socket wrench or Torx™ wrench. Preferably, little force should be required to remove the pin 22 from the shell 24. Thus, in the embodiment of FIG. 3, the shoulder 28 may be threaded and the support section 30 may include a base end 32 having a hexagonal cross-sectional area, thus allowing a mold technician to use a wrench to unscrew the pin 22 from the shell for removal. For such embodiments, the cone 34 of the base 36 may be provided with an opening configured to receive the base end 32 of the pin 22. After the investment mold has set, the base 36 may be removed from the flask (not shown), and the pin 22 turned to unscrew it from the shell 24. In yet another embodiment, if the pin 22 comprises metal or other readily heat conductive material, the pin 22 may be heated to partially melt the shell 24 and allow easier removal of the pin 22. In other embodiments, the pin 22 may be released from the shell and investment mold during the pattern burn out process as the investment mold is heated in an oven. The pin 22 may comprise any suitably rigid material, such as metal, alloy, ceramic, metal/ceramic material, stiff plastic, wood or glass. In yet other embodiments, the pin 22 may be permanently mounted to the base 36, or may be formed with the base 36 as an integrated structure.

In other embodiments, the pin 22 may be of constant diameter, or may include one or more curves or taper angles. The pin 22 may be hollow, or may be perforated to better retain a shell 24. By using a relatively rigid pin 22, a sprue may be made much thinner than prior art sprues of solid wax or plastic, yet still remain sufficiently rigid for pattern attachment. A thinner sprue may result in smaller channels in the investment mold, which may correspondingly reduce the amount of molten metal that fills the channels after casting and must be recovered for reuse. This may yield a better ratio of castings to sprue weight per mold.

Figure 4:
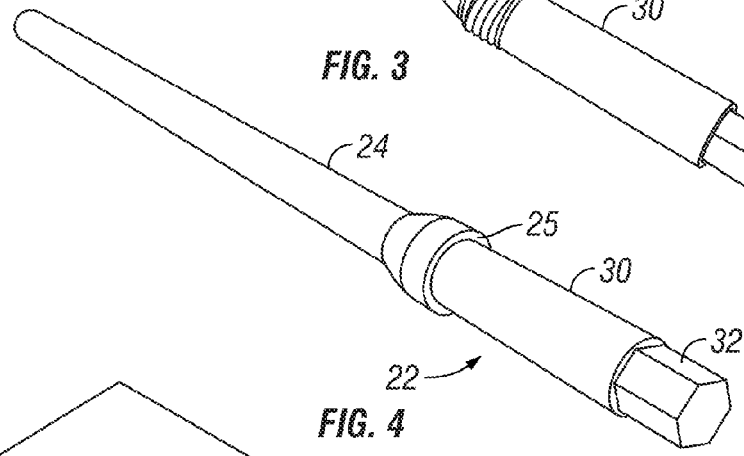
FIG. 4 provides a perspective view of the pin of FIG. 3 at least partially enclosed by a shell.

FIG. 4 illustrates the pin of FIG. 3 having a shell 24 mounted thereto. As may be seen in FIG. 4, the shell 24 may cover the pin shoulder 28, and may form a ridge end 25 with respect to the support section 30 of the pin 22. The ridge end 25 may help seat the pin 22 in a base. The shell 24 may have a substantially constant wall thickness, may have a tapering wall thickness or may have any other wall thickness variation suitable for the investment casting process. The shell wall thickness may depend on the size, shape, weight and placement of pattern on the sprue. Preferably, the shell 24 comprises wax or plastic or other organic material suitable for mounting patterns. In other embodiments, the shell may completely enclose the pin.

Figure 5:
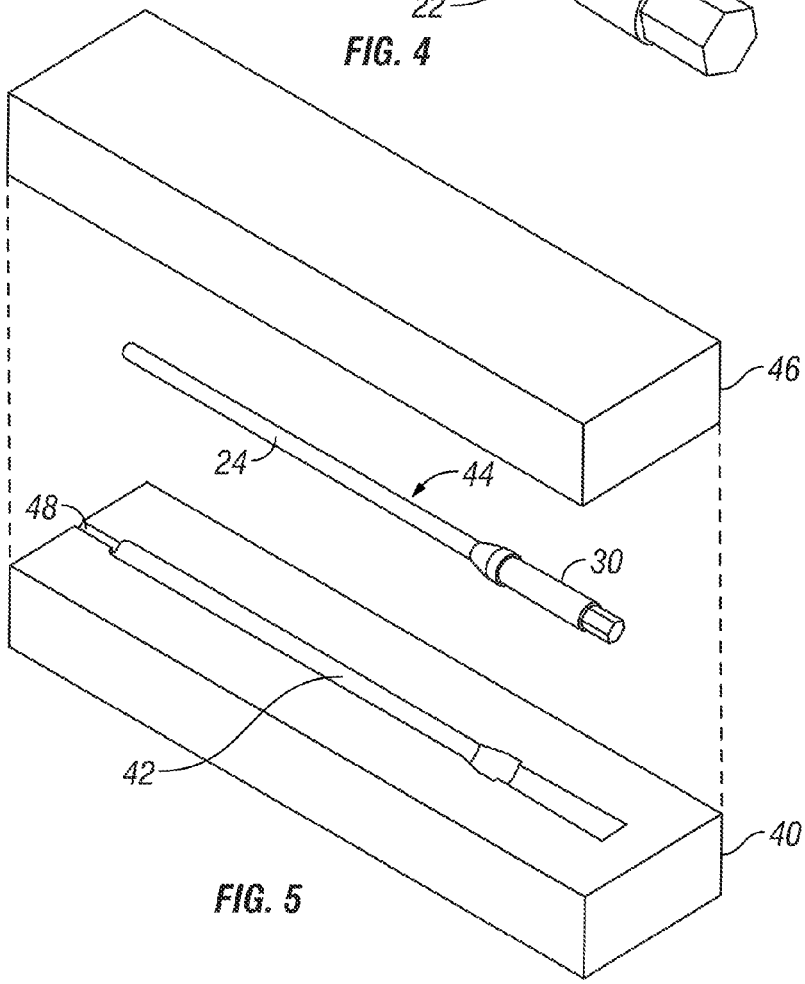
FIG. 5 provides an exploded view of an embodiment of a mold for at least partially enclosing a pin in a shell.

The shell 24 may be applied to the pin 22 in a variety of ways. As shown in the embodiment of FIG. 5, a mold may be used to enclose a pin 22 in a shell 24. A first mold block 40 may comprise a recess 42 configured to receive the pin 22. The recess 42 may be configured to snugly receive the support section 30 of the pin 22 such that when the pin 22 is placed in the recess 42 and a second mold block 46, also having a recess (not shown) to receive the pin 22, is clamped to the first mold block 40, the shaft 26 and shoulder 28 of the pin 22 do not contact either the first mold block 42 or the second mold block 46. The first mold block 40 and second mold block 46 may be held together using any suitable device, such as a jig, clamp, weighted object, rubber bands, and the like. An injection port 48 may allow melted wax or plastic to flow into the mold and around the pin shaft 26 and pin shoulder 28. After the wax or plastic hardens over the pin 22 to form a sprue 44, the two mold blocks 40 and 46 may be separated, and the sprue 44 may be removed from the mold. Of course, the mold may comprise any suitable material, such as metal or ceramic, and comprise one or more blocks or parts, depending, e.g., on pin and shell design and material. Preferably, the recess 42 is configured to form a smooth shell surface that will leave a relatively smooth channel in the investment mold. Smoother channels in the investment mold tend to reduce the turbulence of molten metal as it is poured into the investment mold. Reducing turbulence may reduce common casting imperfections, such as porosity and inclusions.

A pin may be enclosed by a shell in other ways, as well, such as by dipping a pin in melted wax or plastic that is then allowed to harden on the pin. Alternatively, melted wax or plastic may be applied with a brush to the pin and allowed to harden. If wax or plastic is provided in a thin sheet, the wax or plastic sheet may be wrapped around the pin and smoothed with a hot knife to create a shell.

Figure 6:
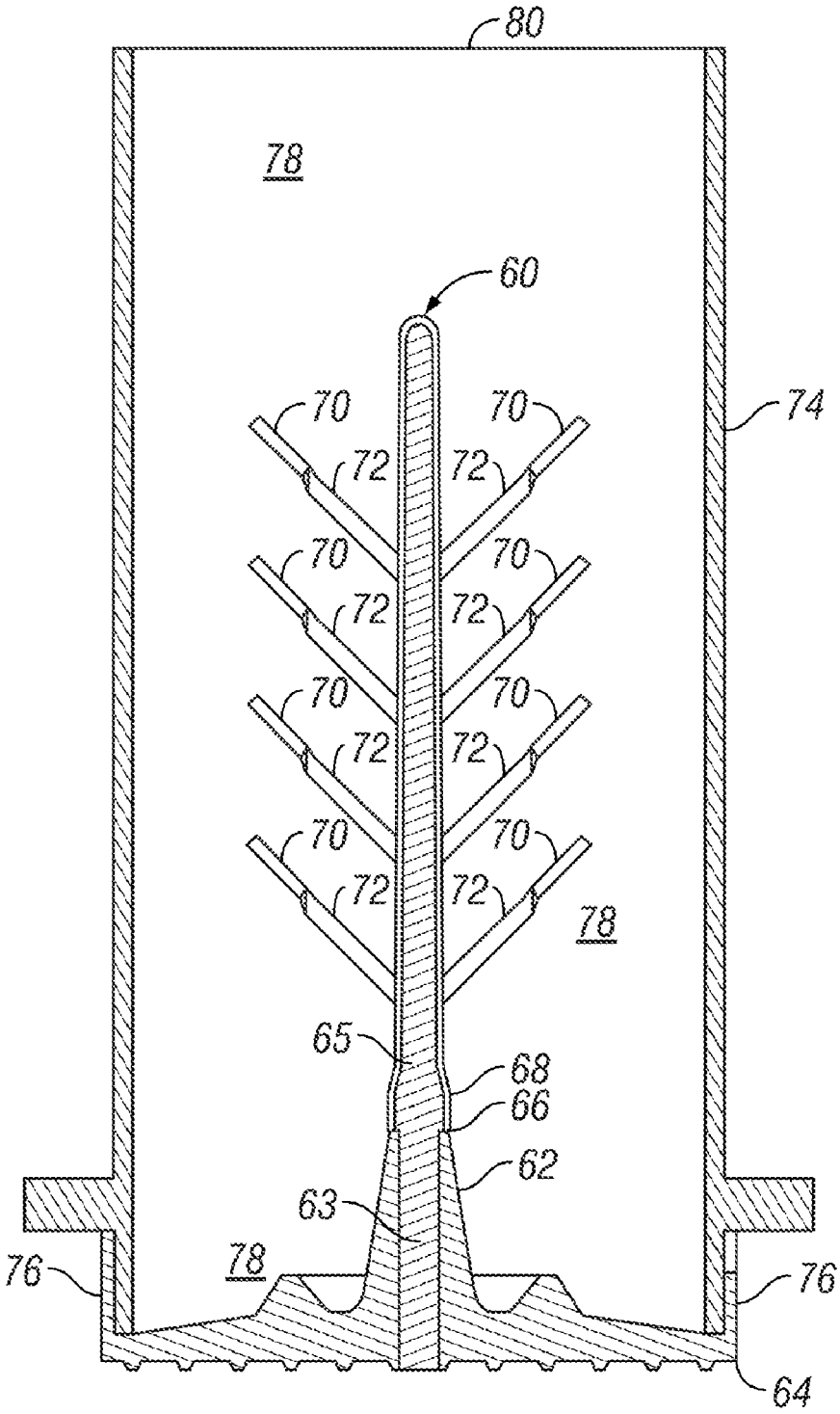
FIG. 6 provides a side cross-sectional view of a tree positioned inside a flask.

As may be seen in FIG. 6, a sprue 60 may be mounted in the cone 62 of a base 64 by inserting the support section 63 of the pin 65 into the cone. The ridge end 66 of the shell 68 may butt against the cone 62, and preferably any gaps between the cone 62 and shell 68 may be sealed with wax or plastic. Patterns 70 with sprue runners or "gates" 72 may be attached to the sprue 60 by known methods to form a tree. For example, if the shell 68 is made of wax, then the sprue runner 72 ends may be dipped into softened or sticky wax or melted with a hot gun, and then held against the sprue 60 until the connection hardens. Alternatively, sprue runners 72 may be attached to the sprue 60 by using globules of softened wax. After the gated patterns 72 are attached to the sprue 60 to form a tree, a flask 74 may be sealingly mounted to the base 64. In the embodiment of FIG. 6, the base 64 comprises flexible rubber. Lip 76 formed in the base 64 may compress against the outer circumference of the flask 74 to substantially prevent investment material 78 from leaking out of the flask 74. Investment material 78 may be poured into the flask through an open top 80, and may flow around the tree. After the flask 74 has been filled with investment material 78 and any trapped air bubbles released, the investment material 78 may be allowed to harden.

Figure 7:
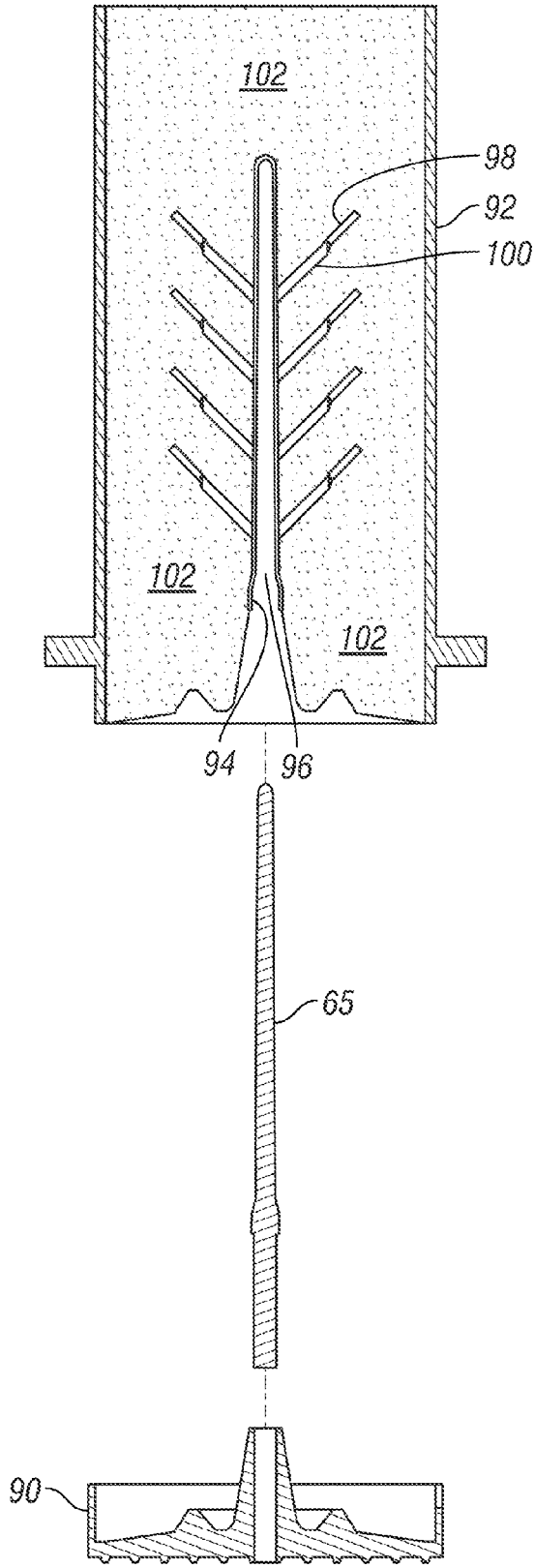
FIG. 7 provides a side cross-sectional view of the tree of FIG. 6 set in investment material, and having the pin removed from the shell and from the base.
Figure 8:
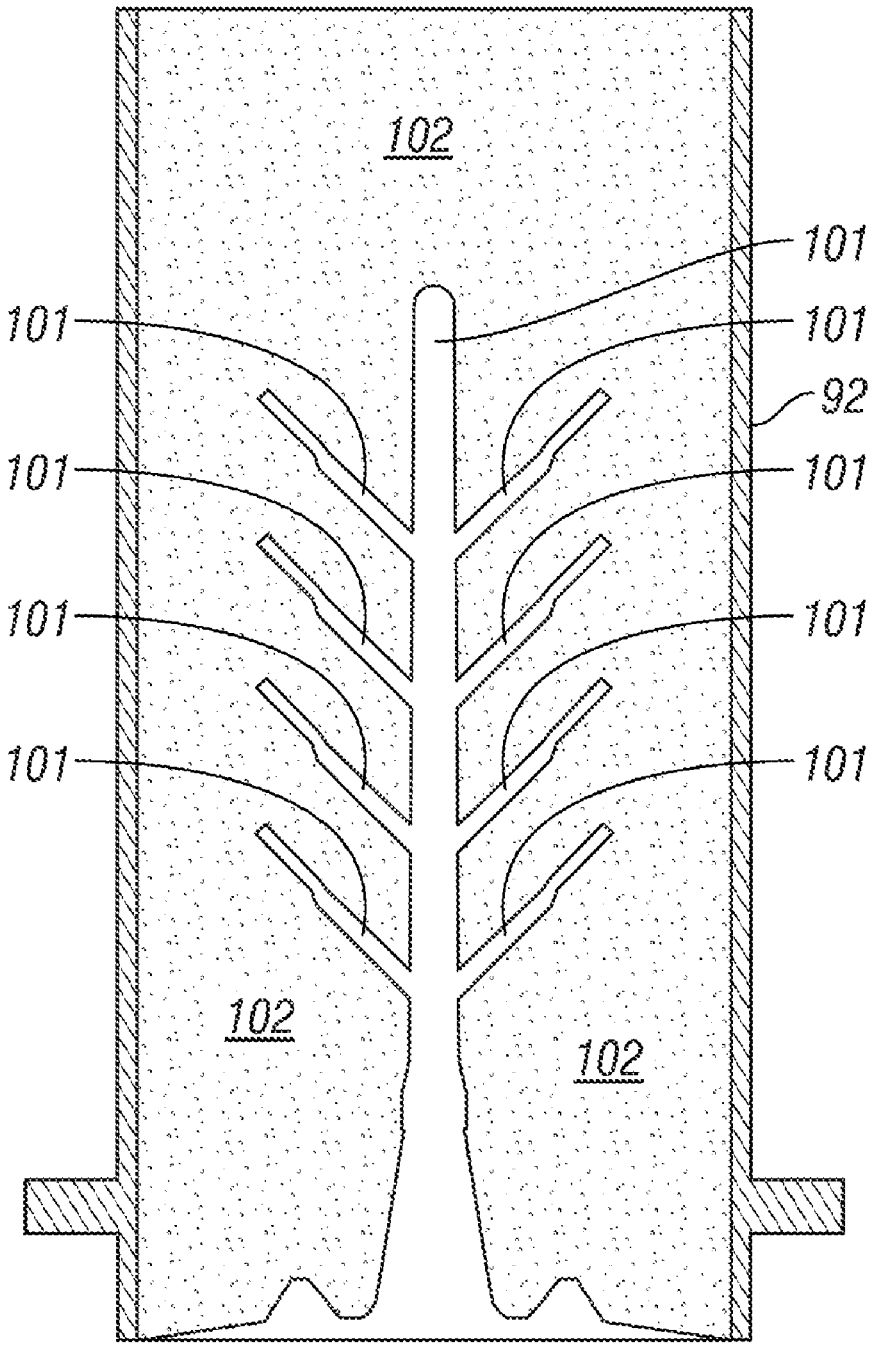
FIG. 8 provides a side cross-sectional view of the channels formed in the investment material after burnout of the tree of FIG. 7.

After the investment material has hardened, the base 90 and pin 65 may be removed from the flask 92, as shown in FIG. 7. In FIG. 7, the base 90 and pin 65 are shown as removed from the flask 92, leaving the sprue shell 94 embedded in the investment mold. Removal of the pin 65 leaves a void 96. The flask 92 and investment material 102 may then be placed in an oven (not shown) for heating. The oven heat melts and/or burns out the shell 94, as well as the patterns 98 and sprue runners 100, resulting, as may be seen in FIG. 8, in an investment mold having channels 101 for receiving molten metal. By using a pin and shell, much less sprue material must be melted or burned out, resulting in fewer gas emissions and other byproducts. By using a pin and shell, the sprue volume may be minimized with respect to the number of patterns that must be mounted, thus reducing the total amount of molten metal required for casting production. After the investment material has cured, it may be turned upside-down so that molten metal may be poured into the cavities left by the tree for casting as described above.

Although the present invention and its advantages have been described in detail, it should be understood that various changes, substitutions and alterations can be made herein without departing from the invention as defined by the appended claims. Moreover, the scope of the present application is not intended to be limited to the particular embodiments of the process, machine, manufacture, composition, or matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods or steps.

I claim:

1. A sprue comprising a pin and a shell, the shell at least partially enclosing the pin, and the pin comprising a smooth surface and being partially tapered so as to allow manual removal of the pin from the shell after investing while the pin and the shell are substantially at room-temperature, wherein the pin comprising a shaft, a support section and a shoulder section, the shell at least partially enclosing the shaft and the shoulder section, the shoulder section comprising threading whereby the pin may be unscrewed from the shell.

2. The sprue of claim 1, the shell comprising wax or plastic.

3. An apparatus for investment casting comprising:

a sprue comprising a pin and a shell, the shell at least partially enclosing the pin, and the pin comprising a smooth surface and being partially tapered so as to allow manual removal of the pin from the shell after investing while the pin and the shell are substantially at room-temperature wherein the pin comprising a shaft, a support section and a shoulder section, the shell at least partially enclosing the shaft and the shoulder section, the shoulder section comprising threading whereby the pin may be unscrewed from the shell;

a base configured to removably support the sprue; and a flask sealingly mountable to the base, the flask being configured to substantially surround the sprue and contain investment material.

4. A method for investment casting comprising the steps of:

at least partially enclosing a pin in a shell, the pin comprising a smooth surface and being partially tapered;

mounting the pin to a base;

affixing patterns to the shell to create a tree;

sealingly attaching the base to a flask such that the flask substantially surrounds the tree;

pouring investment material into the flask to substantially submerge the patterns in the investment material;

allowing the investment material to harden into an investment mold;

manually removing the pin from the shell while the pin and the shell are substantially at room-temperature; then removing the shell and patterns from the investment mold; and pouring molten metal into the investment mold.

* * * * *